US008640275B2

(12) United States Patent
Lawson et al.

(10) Patent No.: US 8,640,275 B2
(45) Date of Patent: Feb. 4, 2014

(54) CLEANING SYSTEMS AND METHODS FOR CLEANING CONTAINERS HAVING NON-VERTICAL SIDEWALLS

(75) Inventors: Gary Lee Lawson, Suffolk, VA (US); Chi Yin Alan Leung, Kowloon Bay (CN); Chung Wai (Paul) Cheng, Kowloon Bay (CN)

(73) Assignee: Polygroup Macau Limited (BVI), Road Town, Tortola (VG)

( * ) Notice: Subject to any disclaimer, the term of this patent is extended or adjusted under 35 U.S.C. 154(b) by 18 days.

(21) Appl. No.: 12/875,512

(22) Filed: Sep. 3, 2010

(65) Prior Publication Data

US 2011/0000838 A1 Jan. 6, 2011

Related U.S. Application Data

(63) Continuation-in-part of application No. 11/934,228, filed on Nov. 2, 2007.

(60) Provisional application No. 61/239,582, filed on Sep. 3, 2009.

(51) Int. Cl.
*E04H 4/00* (2006.01)

(52) U.S. Cl.
USPC ..... 4/507; 4/508; 4/509; 4/506

(58) Field of Classification Search
USPC ..... 4/504, 507, 509; 210/167.1, 167.12, 210/416.1, 416.2
See application file for complete search history.

(56) References Cited

U.S. PATENT DOCUMENTS

| | | | |
|---|---|---|---|
| 1,940,316 | A | 12/1933 | Mckinley |
| 2,919,765 | A | 1/1960 | Kasten |
| 3,357,563 | A | 12/1967 | Sicard |
| 3,363,268 | A | 1/1968 | Friedlander |
| 3,631,544 | A | 1/1972 | Tytel |
| 3,772,193 | A | 11/1973 | Nelli et al. |
| 4,342,730 | A | 8/1982 | Perrotta |
| 4,587,599 | A | 5/1986 | St-Hilaire |

(Continued)

FOREIGN PATENT DOCUMENTS

| | | |
|---|---|---|
| DE | 102008012314 | 9/2008 |
| FR | 2925547 A1 * | 6/2009 |
| GB | 2443169 | 4/2008 |

OTHER PUBLICATIONS

Machine Translation of FR2925547A1.*

(Continued)

*Primary Examiner* — Huyen Le
*Assistant Examiner* — Erin Deery
(74) *Attorney, Agent, or Firm* — Benjamin C. Wiles, Esq.; Ryan A. Schneider, Esq.; Troutman Sanders LLP

(57) ABSTRACT

Devices combining swimming pool skimmers, pumps, and removable, disposable filters into integral, sidewall-mounted systems for above-ground pools and other above-ground liquid containment enclosures, and methods for the use of such systems to remove both larger floating debris and smaller particulate matter to maintain water clarity and hygienic safety within such pools or like liquid containment enclosures are disclosed herein. Specifically, a ring-type above-ground pool comprising a base, a sidewall, and at least a portion of a cleaning system solely supported by the sidewall and mounted at a non-vertical angle such that it is substantially parallel to the sidewall.

17 Claims, 10 Drawing Sheets

(56) References Cited

U.S. PATENT DOCUMENTS

| | | | | |
|---|---|---|---|---|
| 4,637,873 | A | 1/1987 | DeSousa et al. | |
| 4,780,197 | A | 10/1988 | Schuman | |
| 4,903,351 | A | 2/1990 | Dengel et al. | |
| 4,997,559 | A | 3/1991 | Ellis et al. | |
| D321,258 | S | 10/1991 | St-Hilaire | |
| 5,181,283 | A | 1/1993 | Gillebaard | |
| 5,277,801 | A | 1/1994 | Lundquist | |
| 5,416,932 | A | 5/1995 | Ventrice | |
| 5,580,448 | A | 12/1996 | Brandreth, III | |
| 5,603,129 | A | 2/1997 | Chou | |
| 5,783,067 | A | 7/1998 | Belden | |
| 5,879,547 | A | 3/1999 | Desjoyaux et al. | |
| 5,881,402 | A | 3/1999 | Devino et al. | |
| D408,546 | S | 4/1999 | Carreau | |
| 5,897,770 | A | 4/1999 | Hatch et al. | |
| 5,930,849 | A | 8/1999 | Marbach | |
| 5,987,661 | A * | 11/1999 | Peterson | 4/506 |
| 6,117,332 | A | 9/2000 | Hatch et al. | |
| 6,325,926 | B1 | 12/2001 | Hansen | |
| 6,416,662 | B1 | 7/2002 | Schmidt | |
| 6,475,379 | B2 | 11/2002 | Jousset et al. | |
| 6,571,405 | B1 | 6/2003 | Saputo et al. | |
| 6,588,028 | B1 | 7/2003 | Wu | |
| 6,626,299 | B1 | 9/2003 | Brown et al. | |
| 6,922,855 | B1 | 8/2005 | Swalley et al. | |
| 2004/0140306 | A1 | 7/2004 | Arias et al. | |
| 2005/0155145 | A1 | 7/2005 | O' Hanlon | |
| 2007/0044224 | A1 * | 3/2007 | Cheng et al. | 4/506 |
| 2008/0216877 | A1 | 9/2008 | Lawson | |

OTHER PUBLICATIONS

International Search Report for British Application No. GB0803285.6 dated Jun. 17, 2008.

Examination Report for related British Application No. GB0803285.6 dated Mar. 28, 2011.

* cited by examiner

CLEANING SYSTEMS AND METHODS FOR CLEANING CONTAINERS HAVING NON-VERTICAL SIDEWALLS

CROSS REFERENCE TO RELATED APPLICATION

This application claims benefit under 35 USC §119(e) of U.S. Provisional Patent Application Ser. No. 61/239,582 filed 3 Sep. 2009 and is a continuation-in-part of U.S. patent application Ser. No. 11/934,228 filed 2 Nov. 2007. Both applications are hereby incorporated fully herein by reference.

BACKGROUND

Embodiments of the present invention relate to a cleaning system and, more particularly, to a cleaning system for treating water and the removal of floating debris for above-ground ring-type swimming pools or other above-ground fluid containers. Embodiments of the present invention further relate to an integrated above-ground swimming pool pump-filter-skimmer system, and to an improved, angled sidewall-mounted housing and replaceable cartridge filter for such integral systems.

Cleaning systems for swimming pools are known in the art. Some existing integrated swimming pool cleaning systems include a pump, skimmer, and filter for cleaning the water contained within the pool. Cleaning systems for above-ground pools are generally supported using a ground level base beside the pool wall, due to their heavy weight.

An exemplary conventional cleaning system is shown in FIG. 1*a*. A conventional cleaning system 20 is fully supported by a base 10 and is in communication with the above-ground pool 100. Such designs present a potential safety hazard in use, because cleaning systems are often improperly used as a step for entering or exiting the pool, particularly by small children. In addition to the associated safety risks (e.g., slipping off the pump, causing injury), standing on the pump housing to enter or exit the pool places a significant physical strain on the mounting and plumbing connections. These items have been designed, for example, to support the pump or to carry water and are not intended to be structural items. Their use as a step or ladder, therefore, can result in water leakage at the connections, pump failure, and/or collapses of the supports.

Moreover, existing integrated swimming pool cleaning systems for above-ground pools are applicable only for use on rigid wall pool designs with straight vertical sidewalls. As a result, this design is incompatible with ring-type swimming pools, which tend to have outwardly leaning sidewalls. The sidewalls require that the pump and base be located further away from the pool at the top than at the bottom to maintain the pump in a vertical orientation. This, in turn, means that the structure used to connect the pump to the pool must be longer to bridge the gap. The increased span further increases the chances of damage to the pump and plumbing, or injury to users. The increase span can also increase manufacturing costs because more and stronger materials are required.

SUMMARY

Briefly described, embodiments of the present invention relate to an above-ground swimming pool having a base, a sidewall, and a pump and filter system. The pump and filter system, or cleaning system, for cleaning the water of the above-ground swimming pool can be fully supportable upon a non-vertical sidewall of the swimming pool. Specifically, the cleaning system for cleaning water of the above-ground swimming pool can be solely supported by the sidewall of a ring-type pool. The sidewalls of ring-type pools, due to their construction, are generally outwardly curving, or bulging, and disposed at an acute angle with respect to the floor of the pool. The cleaning system, therefore, can include various portions, including a housing, a filter assembly, a skimmer assembly, and a pump assembly suitable for mounting at a non-vertical angle on the sidewall of a ring-type pool.

To clean the water in the pool, the pump assembly can draw water and debris from the pool into the housing. Larger debris can be captured by the skimmer assembly, or strainer, while smaller debris not captured by the skimmer assembly can be filtered out by the filter assembly. The pump assembly can then pump the clean water back into the pool via a return line.

In one embodiment, a ring-type above-ground container is capable of holding a fluid, and comprises a base; at least one sidewall in communication with the base; and a cleaning system solely supported by a portion of the sidewall. The cleaning system can be supported and operable at an angle that is similar to the angle between the non-vertical sidewall and the floor of a ring-type above-ground pool. The cleaning system can thus be supported at a non-vertical angle and be disposed substantially parallel to the sidewall of a ring-type above-ground pool. The cleaning system can comprise a housing defining a hollow cavity, wherein the housing is fully supported by the sidewall of the above-ground container, such that no portion of the cleaning system is supported by a ground surface upon which the base of the pool is supported.

The cleaning system can further comprise a filter assembly disposed within the hollow cavity of the housing. The filter assembly can be adapted to filter debris out of the fluid in the above-ground container. The cleaning system can further comprise a skimmer assembly disposed within the hollow cavity of the housing. The skimmer assembly can be adapted to gather larger debris out of the fluid of the above-ground container. In addition, in some embodiments, the cleaning system can further comprise a pump assembly in fluid communication with the housing. In a preferred embodiment, the pump can be removably secured to a first end of the housing to enable pump service and/or replacement.

The pump assembly can be adapted to control the filter assembly and the skimmer assembly. The pump assembly can be further adapted to extract and/or circulate fluid and debris from the above-ground container to be filtered by the filter assembly and be gathered by the skimmer assembly. A return line can be coupled to the sidewall of the above-ground container and the pump assembly to permit fluid extracted from the above-ground container to be returned to the above-ground container. The sidewall of the ring-type above-ground container can be non-rigid and/or flexible and disposed in a non-vertical, angled, or curved manner.

To the accomplishment of the foregoing and related ends, the following description and annexed drawings set forth in detail certain illustrative aspects and implementations of the invention. These are indicative of but a few of the various ways in which the principles of the invention may be employed. Other aspects, advantages, and novel features of the invention will become apparent from the following detailed description of the invention when considered in conjunction with the drawings.

DETAILED DESCRIPTION

Embodiments of the present invention are described in the context of being a cleaning system for ring-type above-ground swimming pools. Because of its light weight, the cleaning system can be solely supported by a sidewall of the pool. Additionally, because of the mounting bracket and filter system design, the cleaning system can be mounted on the non-vertical sidewall of a ring-type pool. In other words, due to their design, ring-type pools have curved walls disposed generally at an acute angle to the floor of the pool; however, embodiments of the present invention enable the cleaning system to be mounted at a similar angle such that the cleaning system is substantially parallel to the sidewall of the pool, non-vertical, and at an acute angle to the floor of the pool.

Embodiments of the invention, however, are not limited to use as a cleaning system with a ring-type above-ground swimming pool. Rather, embodiments of the invention can be used to clean many different above-ground containers capable of holding a fluid that is needed or desired and that requires mounting the cleaning system to a non-framed structure. Thus, the cleaning system for filtering and skimming the water in a swimming pool described can also find utility as a cleaning system for a cleaning a variety of fluids contained in various above-ground containers, including but not limited to, cisterns, storage tanks, fountains, and water features.

To facilitate an understanding of the principles and features of the invention, it is explained hereinafter with reference to its implementation in an illustrative embodiment. As used herein, "pool" refers to and includes an above-ground or free-standing swimming pool, spa, water tank, or other above-ground liquid containment enclosure.

The materials described as making up the various elements of the container of the invention are intended to be illustrative and not restrictive. Many suitable materials that would perform the same or a similar function as the materials described herein are intended to be embraced within the scope of the invention. Such other materials not described herein can include, but are not limited to, materials that are developed after the time of the development of the invention, for example.

Figure 1A:
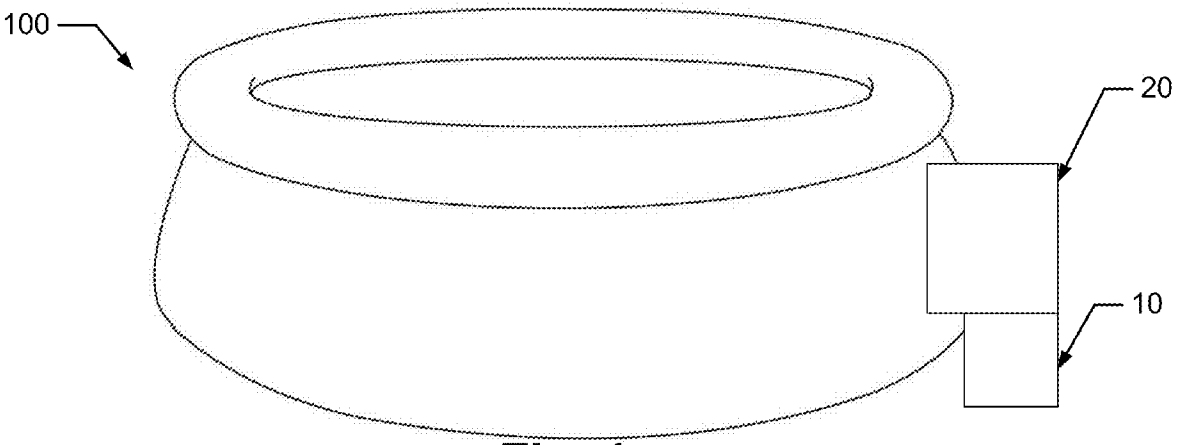
Fig. 1a Prior Art
FIG. 1*a* is a perspective view of a conventional above-ground container having a conventional cleaning system connected thereto and supported by a base.
Figure 1B:
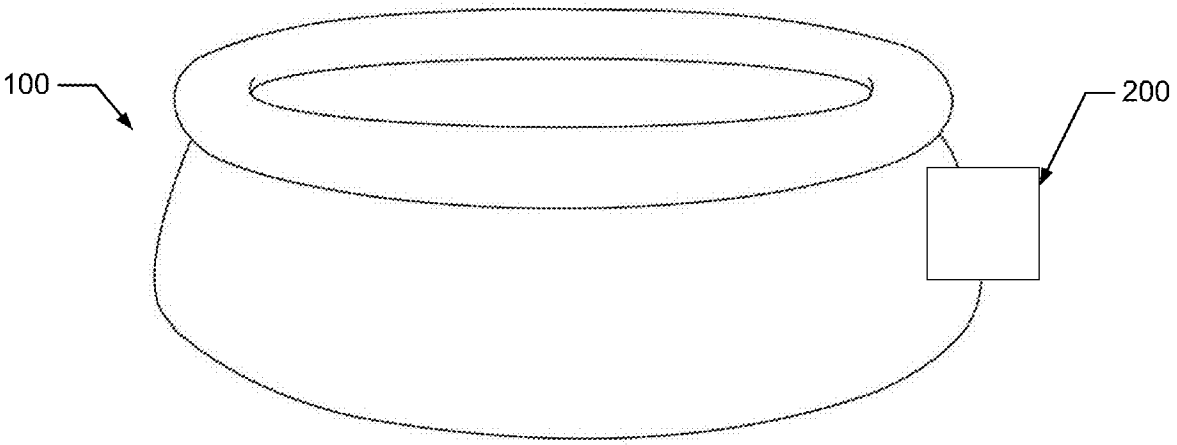
FIG. 1*b* is a perspective view of an above-ground container fully supporting a cleaning system, in accordance with an exemplary embodiment of the present invention.

Referring now to the drawings, wherein like reference numerals represent like parts throughout, an environment of the cleaning system is illustrated in FIG. 1*b*. An above-ground pool 100 can solely support a cleaning system 200 for cleaning the water in the pool. Specifically, a base is not needed to support the cleaning system 200; rather, a sidewall of the pool is adapted to support the full weight of the cleaning system 200. The above-ground pool 100 can be a non-framed container or structure.

Above-Ground Swimming Pools

The cleaning system is securable and supported by a container, e.g., a portable swimming pool, constructed in accordance with the following description. Four different containers can be seen in the perspective views illustrated in FIGS. 2*a*-2*d*. As shown in FIGS. 2*a*-2*d*, an above-ground swimming pool 100 has a base 110 and a sidewall 120, which is made from a physical material and is formed in a particular shape.

The pool 100 can be a pop-up type of pool, which is collapsible in nature. A frame pool, for example, is typically pre-fabricated and includes a plurality of external vertical braces or frames for supporting the frame pool above the ground (see, FIGS. 2*a* and 2*b*). Frame pools can be made of metal, plastic, and the like. Pop-up, or ring-type, pools, on the other hand, are adapted to rise with the amount of water inserted into pool (see, FIG. 2*c*), and may additionally be outfitted with external braces or frames for support (see, e.g., FIG. 2*d*). Other types of pools and containers can also be used with the present cleaning system.

The pool 100 is formed with the base 110 and sidewall 120. The base 110 and sidewall 120 can be manufactured out of many different materials and can be formed of the same materials or each from a different material. In some embodiments, the base 110 and sidewall 120 of the swimming pool 100 can be formed from a natural textile, such as for example and not limitation, cotton or burlap. In other embodiments, the base 110 and sidewall 120 of the swimming pool 100 can be formed from a synthetic material, including but not limited to plastics, polyurethane, PVC, or nylon. Many materials (especially water-permeable textiles, etc.) can be used to construct a pool, provided they are treated to retain water. For example, such materials could be adhered to, laminated with, coated with, or bonded to a material impermeable to water.

In accordance with an exemplary embodiment, the base 110 can be formed from a nylon shell, which can be laminated or otherwise treated to hold water. For example, the nylon shell might be bonded to another material, such as polyurethane, PVC, vinyl, or other suitable impermeable lining to provide the desirable waterproof qualities, and to provide a more pleasing tactile quality to the interior of the pool 100. Similarly, the sidewall 120 of the pool 100 can be constructed from these materials, or other materials having similar suitable qualities and durability.

In some embodiments, the base 110 and sidewall 120 can be constructed, or molded, from a single piece of material to minimize seams and other possible weak points. In other embodiments, the base 110 can be formed from materials that provide more durable than the sidewall 120, as this section of the pool 100 would likely be subjected to more wear than that experienced by the sidewall 120. In addition, as described, the base 110 and sidewall 120 can be formed from a combination of materials, which can be adhered or bonded together. The materials used for the various portions of the pool 100, including, for example, the base 110 and the sidewall 120, can be joined by way of a number of commonly known suitable techniques, such as sewing, adhesives, bonding, lamination, RF welding, or other suitable joining techniques. The connection of the base 110 to the sidewall 120 can be along the bottom 122 of the sidewall 120. The base 110 includes a perimeter, wherein the sidewall 120 can be connected to the perimeter of the base 110.

In some embodiments, the inner sidewall 126 can be made of pliable plastic, while the outer sidewall 128 can be made of hard plastic. In this configuration, the inner sidewall 126 can limit leakage of fluid should the outer sidewall 128 crack. Similarly, the material of the inner sidewall 126 can be made of hard plastic, and the material of the outer sidewall 128 can be made of pliable material to protect from potential leakage should the hard plastic crack. In another embodiment, both the inner sidewall 126 and the outer sidewall 128 can be made of hard plastic.

Figure 2C:
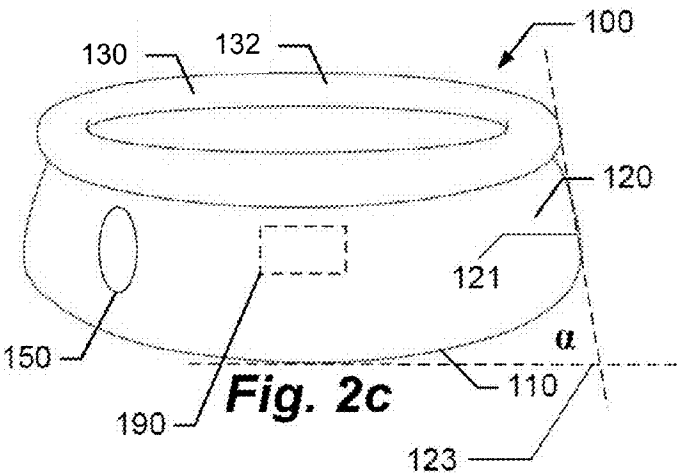
FIG. 2*c* is a perspective view of yet another above-ground container, specifically a ring-type swimming pool.
Figure 2D:
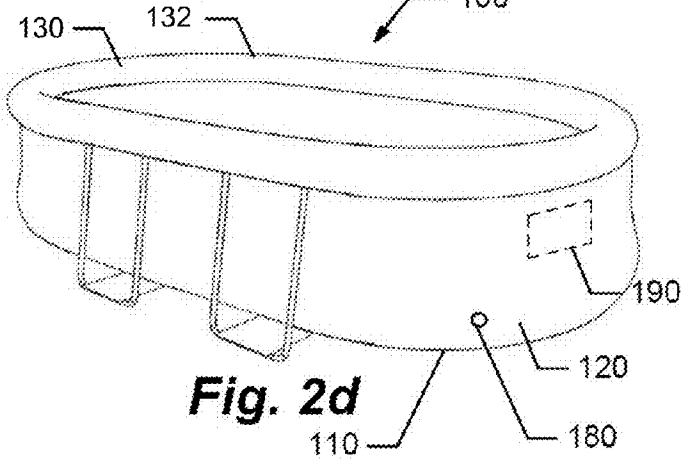
FIG. 2*d* is a perspective view of another above-ground container, specifically an oval ring-type swimming pool.
Figure 2A:
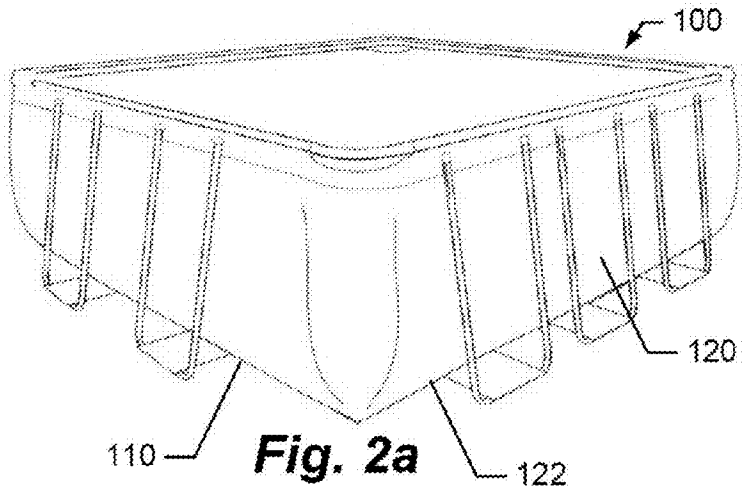
Fig. 2a Prior Art
FIG. 2*a* is a perspective view of above-ground container, specifically a rectangular frame swimming pool.
Figure 2B:
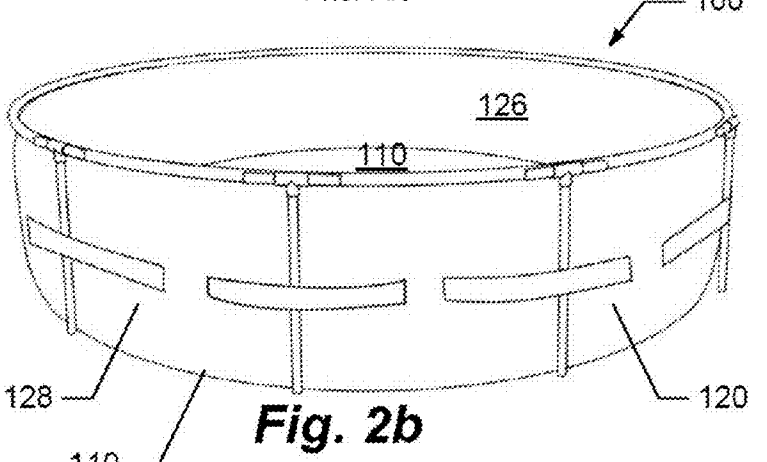
Fig. 2b Prior Art
FIG. 2*b* is a perspective view of another above-ground container, specifically a round frame swimming pool.

The pool 100, as illustrated in FIGS. 2*c*-2*d*, can further include a floatation device 130, which is formed in the general shape of the base 110 and attached to the top 124 of the sidewall 120. In an exemplary embodiment, shown in FIGS. 2*c*-2*d*, the floatation device 130 can be an inflatable ring 132. When inflated, the ring 132 can provide additional stiffness at the top 124 of the sidewall 120 and can help maintain the overall shape of the pool 100. Moreover, the inflatable ring 132 can provide padding for users entering and exiting the pool 100.

Additionally, the floatation device 130 can be buoyant and configured to rise with the level of water within the pool 100, such that as water is deposited in the pool 100, the floatation device 130 rises with the level of that water and automatically erects the sidewall 120 as the pool 100 is filled. When the pool 100 is fully inflated, the floatation device 130 can form a semi-rigid or rigid top portion of the pool 100. In some embodiments, when fully inflated, the flexible sidewalls 120 can bulge slightly outward due to the weight of the water in the pool 100. See, FIG. 2*c*. As a result, a straight line drawn from the outer edge of the floatation device 130, tangent to the outermost portion 121 of the sidewall 120, and intersecting the ground 123 can form an acute angle $\alpha$ with the vertical.

The floatation device 130 can be made from a variety of materials. For example, the floatation device 130 can be an inflatable polyurethane casing, or similar casing that is suitable for retaining air or other gas in an inflated state. The floatation device 130 can be inflated by conventional means, such as a valve configured for oral inflation or for inflation by a device such as a pump or an air compressor. In some embodiments, the floatation device 130 can further comprise a one-way valve to facilitate inflation. The floatation device 130 can also be made from material that does not require inflation, but nonetheless provides adequate buoyancy. For example, special foams, polystyrene, or other materials can be used to create a floatation device 130.

In some embodiments, the pool 100 can be a collapsible pool. For example, the pool 100 and floatation device 130 can be made of a material that can be folded or bent without becoming damaged. In this configuration, the pool 100 can be conveniently collapsed simply by draining the pool and deflating the inflatable ring 132. The pool 100 and ring 132 can then be folded into a convenient shape for easier transportation or storage.

Additionally, as illustrated in FIG. 2*c*, the pool 100 can comprise one or more portholes 150. The portholes 150 are translucent sections of the sidewall 120, integrally formed in/with the sidewall either 120, or separate elements. The portholes 150, or windows, permit one to see into, or out of, the pool 100. The portholes 150 can further be useful to determine the level of fluid within the pool 100.

The portholes 150 can comprise many shapes. For instance, the shape of the portholes 150 can be oval, circular, or triangular, though other shaped are contemplated. In an exemplary embodiment, the locations of the portholes 150 can be placed symmetrically about the sidewall, though this is not strictly necessary.

The portholes 150 can aid in safety by enabling a parent or lifeguard, for example, to view into the pool 100 through the sidewall 120. In some embodiments, the portholes 150 can be removable, wherein they are attached to the pool 100 via a waterproof/leak resistant means. This can enable the portholes 150 to be used as a drainage device and can enable the pool 100 to be emptied quickly. In some embodiments, the portholes 150 can be integrally formed during manufacturing of the sidewall 120. The portholes 150 can also be included via a non-removable method, wherein the portholes are secured within the sidewall 120, yet non-integral.

In some embodiments, the porthole 150 can comprise an inner portion and an outer portion that are bolted together, or otherwise affixed. In this configuration, the side wall 120 of the pool can be sandwiched between the inner portion and the outer portion, providing a water-tight seal. In other embodiments, the porthole 150 can be molded or welded into the sidewall to form an integral unit. In this configuration, the porthole can comprise clear plastic, or other suitably flexible material, to enable the porthole 150 to be folded along with the sidewall 120.

In some embodiments, the pool 100 can include a ladder (not shown) to enable one to enter and exit the pool 100. In some embodiments, the ladder can be free-standing outside the pool 100. In other embodiments, the ladder can be, for example, an A-frame type ladder, such that a portion of the ladder is outside the pool 100 and a portion of the ladder is inside the pool 100. In some embodiments, the ladder can be flush with the rim for easy entry/exit from the pool 100.

Because the pool 100 can be collapsible, it is desirable for the fluid in the pool 100 to be drainable. A drainage assembly 180, as illustrated in FIG. 2*d*, can be integrated with the sidewall 120 of the pool 100. In an exemplary embodiment, the drainage assembly 180 can be a stopper or like device, that is removable from the pool 100, such that, when removed the water from the pool 100 can be drained. The drainage assembly 180 can also be a valve enabling control of the drainage (e.g., to prevent overloading storm sewers). The drainage assembly 180 can be many devices enabling easy draining of the pool 100, safely and environmentally.

The various embodiments described above can provide a swimming pool that is collapsible, easy to store, and that provides increased portability when compared to prior approaches. Additionally, in some embodiments, the collapsible swimming pool can be provided with a pop-up mechanism that automatically erects the pool to its full-sized, or expanded, configuration. The swimming pool can be constructed from durable, lightweight, foldable materials which are not easily damaged, and therefore contribute to long life.

The disclosures and teachings of U.S. patent application Ser. No. 11/466,681 filed 23 Aug. 2006 and U.S. patent application Ser. No. 11/934,220 filed 2 Nov. 2007 are incorporated herein by reference in their entirety.

Cleaning System

Figure 3A:
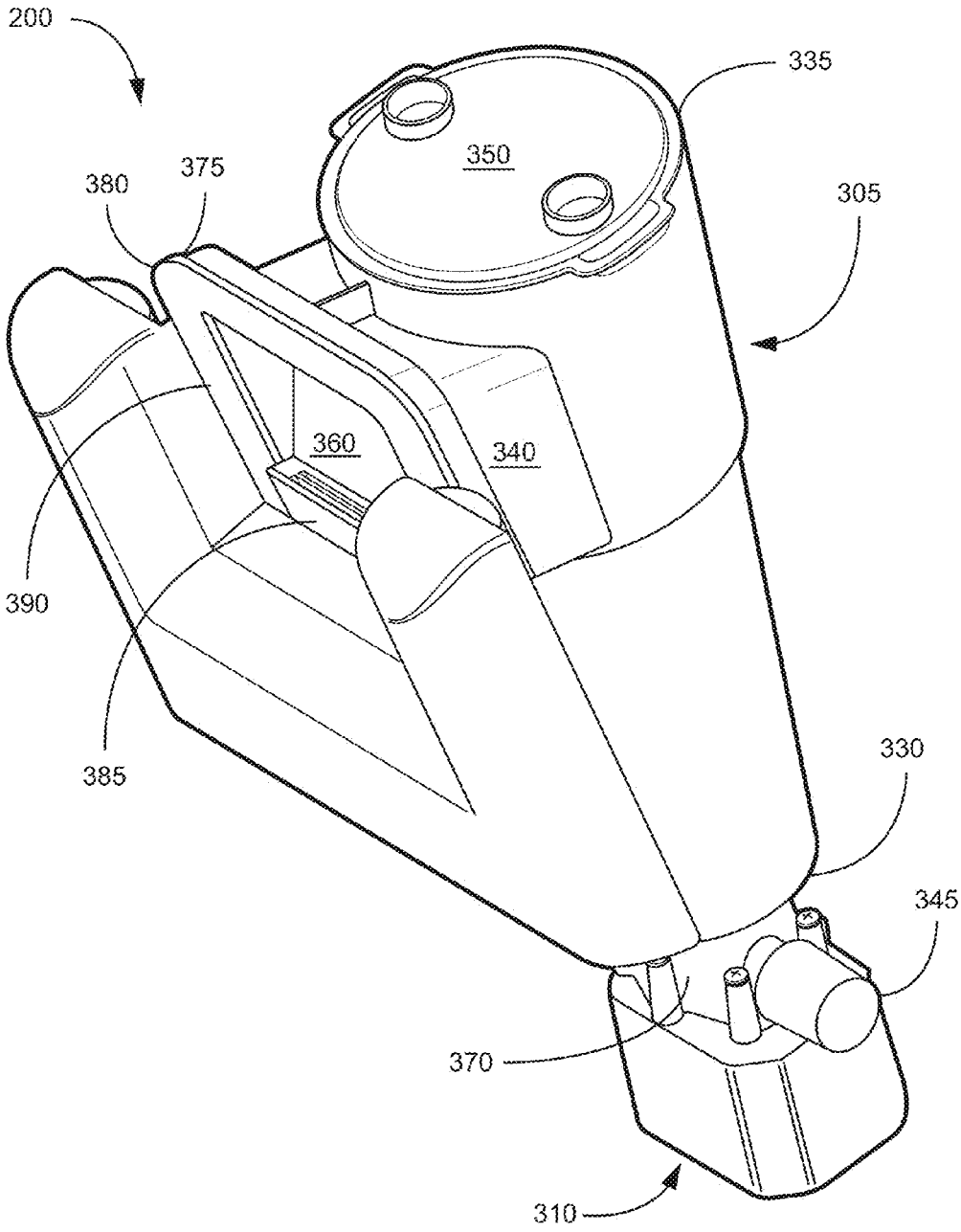
FIG. 3*a* is a perspective view of a cleaning system, in accordance with an exemplary embodiment of the present invention.
Figure 3B:
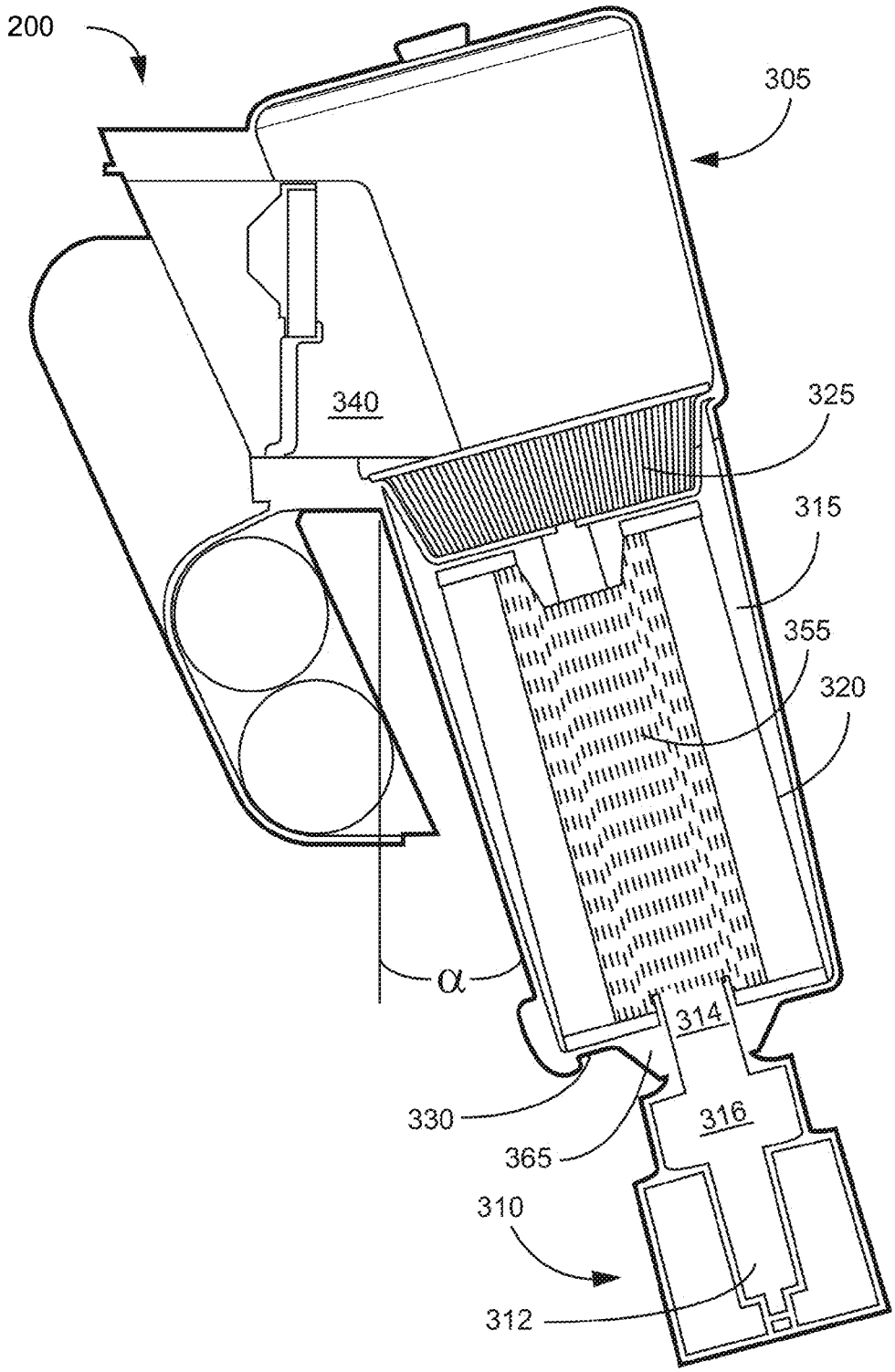
FIG. 3*b* is a cutaway view of the cleaning system of FIG. 3*a*, in accordance with an exemplary embodiment of the present invention.

Generally, and as illustrated in FIGS. 3*a* and 3*b*, embodiments of the present invention relate to a cleaning system for cleaning the fluid in an above-ground container. More specifically, embodiments of the present invention are a cleaning system for cleaning, filtering, and skimming the water in a ring-type above-ground swimming pool. The cleaning system can be lightweight enough to be supported, for example, on the sidewall of the ring pool. As a result, a base, on the ground beside the pool wall, to support the cleaning system is obviated.

Referring back to FIG. 2*c*, the shape of the ring-type pool 100 can be, for example and not limitation, circular or oval. Due to the construction of the ring-type pool, the sidewalls 120 tend to be slightly bulging and non-vertical. As a result, a straight line drawn from the outer edge of the floatation device 130, tangent to the outermost portion 121 of the sidewall 120, and intersecting the ground 123 tends to form an acute angle $\alpha$ with the vertical. This angle $\alpha$ can present at least two problems for a conventional filter and pump assembly 20.

A first problem is caused by the excessive weight of the convention pump and filter system 20, which requires the pump 20 to be mounted on a support 10. The outwardly curving shape of the ring pool 100 requires the pump 20 and support 10 to be placed farther away from the pool 100 than is generally necessary for other types of pools. This, in turn, requires the plumbing and/or channel, used to place the pump 20 in fluid communication with the pool 100, to be longer than would otherwise be necessary. The longer connections are more susceptible to damage and more likely to cause injury due to their placement. The longer connections also require more and stronger materials to effect fluid communication.

A second problem is that, in order to be mounted closely to the sidewall of a ring-type pool, the cleaning system must be mounted at an angle $\alpha$. Due to the pump design in a conventional cleaning system, this angle creates problems including pump cavitation, bearing failure, and improper flow. Embodiments of the present invention, therefore, are designed to pump and filter the pool 100 properly in a non-vertical position without cavitation, bearing failure, or other problems associated with mounting the cleaning system in a non-vertical orientation.

As shown in FIGS. 3*a* and 3*b*, the cleaning system 200 can comprise a housing 305, a filter assembly 320, a skimmer assembly 325, a pump assembly 310, and a return hose connector 345. The housing 305 can define a hollow cavity 315 that can be supported at an angle $\alpha$ by the sidewall 120 of the pool 100. The skimmer assembly 325 can be disposed within the hollow cavity 315, and can be adapted to gather larger debris from the fluid contained within the pool 100. The filter assembly 320 can also be disposed within the hollow cavity 315, and can be adapted to filter smaller debris from the fluid in the pool 100.

Figure 4:
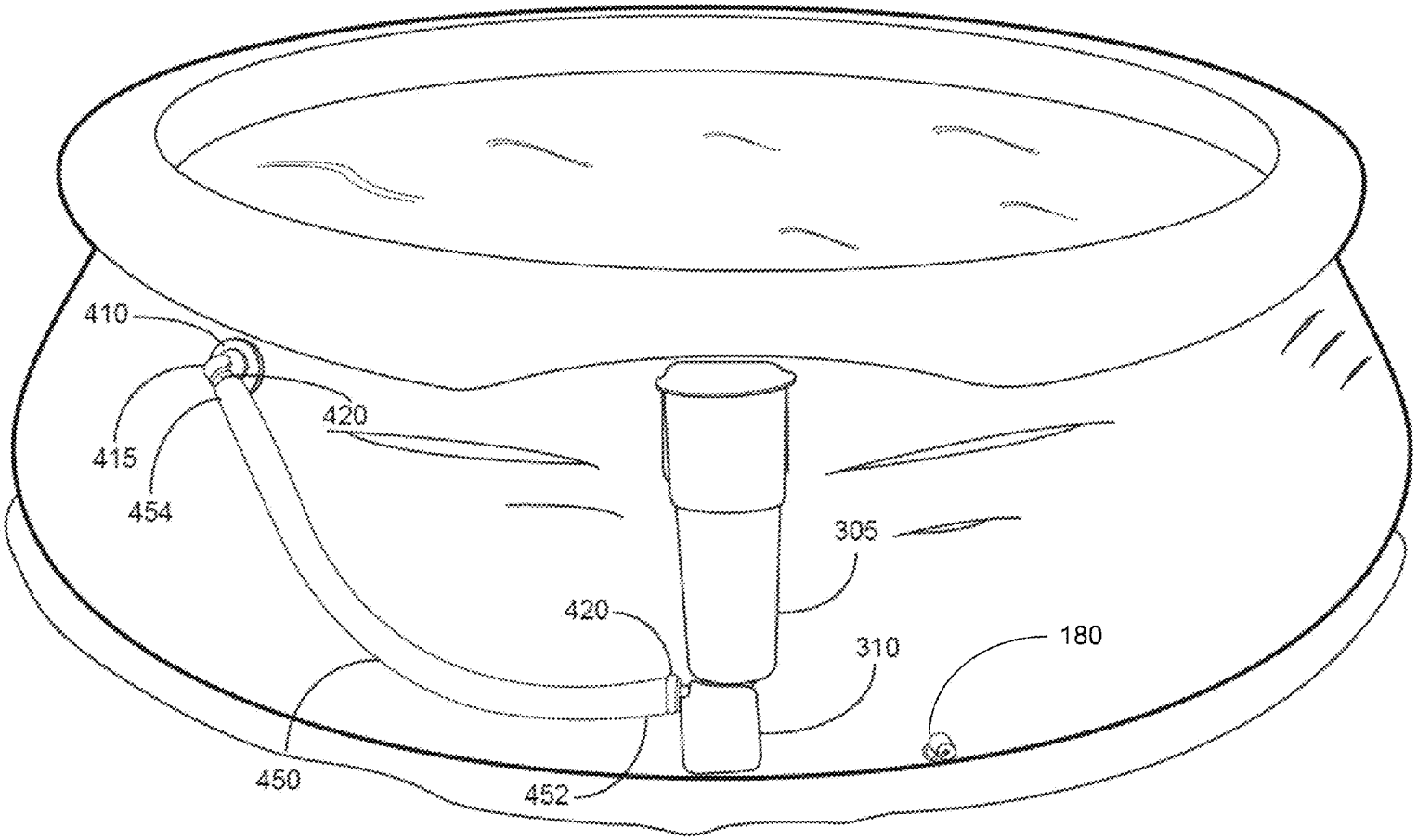
FIG. 4 is a perspective view of a ring-type pool with the cleaning system of FIGS. 3*a* and 3*b* mounted on a sidewall, in accordance with an exemplary embodiment of the present invention.

The pump assembly 310 can be removably securable to a lower portion 330 of the housing 305. The pump assembly 310 can be adapted to pump fluid and debris from the pool 100 through the filter assembly 320 and skimmer assembly 325 and back to the pool 100. As shown in FIG. 4, the return hose 450 can be coupled to the sidewall 120 and the pump assembly 310, and can enable fluid extracted from the pool 100 to be removed, filtered, and re-inserted into the pool 100.

The housing 305 can be supported by the sidewall of the above-ground container by an angled attachment assembly or bracket 340. The angled bracket 340 can enable the housing 305 to be attached to, for example, a ring-type pool 100. In some embodiments, the housing 305 can be connected to the pool 100 by gaskets 375, 380, such that the housing 305 forms a water tight seal with the sidewall 120. The return hose 450 can be coupled to the sidewall 120 via a return line fitting 410 that can be similarly watertight.

FIG. 3*a* illustrates the cleaning system 200 comprising housing 305 and the pump assembly 310. The housing 305 can include a lower portion 330 and an upper portion 335. The pump assembly 310 can be coupled to the lower portion 330 of the housing 305. FIG. 3*a* also illustrates the attachment assembly 340 by which the cleaning system 200 can be secured to the pool 100. The housing 305 further comprises a return hose connector 345, by which the return line (see, FIG. 4, element 450) can be coupled to the pump assembly 310. The upper portion 335 of the housing 305 can be configured to receive a lockable top 350, which can be received by threads, locking detents, or other securely engaging retaining means within the upper portion 335 of the housing 305. The top 350 can be removable, enabling access into the hollow cavity 315.

While an exemplary housing 305, illustrated in the figures, can be generally cylindrical, housings in various embodiments of the present invention can take many shapes, for example and not limitation, rectangular, rounded, non-rounded, or polygonal. In some embodiments, the housing can be manufactured using injection molding to create a light, strong, unitary housing, though other techniques are contemplate. The housing can be manufactured from, for example and not limitation, PVC, polyethylene, aluminum, pot metal, or stainless steel. In a preferred embodiment, the housing is injection molded from PVC or Polyethylene.

The skimmer assembly 325 can be positioned above the filter assembly 320 to remove large debris, such as for example and not limitation, leaves, insects, and amphibians, from the water prior to entering the filter cartridge 355. Specifically, adjacent to the housing 305 upper portion 335, a skimmer port 360 can be in open fluid communication with the pool 100 and the interior of the housing 305. In some embodiments, the skimmer assembly 325 can be positioned below the water level of the pool 100, such that water entering the housing 305 through the skimmer port 360 can first drain through the skimmer assembly 325.

The filter assembly 320 can be positioned within the housing 305 below the skimmer assembly 325. The filter assembly 320 can comprise a removable filter cartridge 355. The filter cartridge 355 can be sized and shaped to filter water-borne particulates too small to be first retained by the skimmer assembly 325. In some embodiments, the filter cartridge 355 can also comprise chemical, bacterial, or other filters, such as for example and not limitation, activated charcoal. The filter assembly 320 and the skimmer assembly 325 can be controlled by the pump assembly 310 in that the pump assembly 310 can be activated to draw water through the skimmer assembly 325 and filter assembly 320. The pump assembly 310 can be positioned near the lower portion 330 of the housing 305. The lower portion 330 can include an aperture 365 sized and shaped to provide fluid communication between the housing 305 and the pump assembly 310.

The pump assembly 310 includes a pump 312 without the need for intervening pipes or other intervening connections. In use, the pump assembly 310 can be controlled by an electrical timer or other electrical or electronic control means (not shown) to allow intermittent or continuous pump operation as desired by a user. The pump assembly 310 can comprise a pump inlet 314 and a pump outlet 316, and can be secured to the housing 305 by a manifold 370.

The manifold 370 can be received into threads, locking detents, or other securely engaging retaining means on the pump inlet 314 of the pump assembly 310. In addition, an O-ring, washer, or other gasket can be interposed between the pump inlet 314 and the manifold 370 to ensure a watertight connection therebetween. Similarly, an O-ring, washer, or other gasket can be interposed between the return hose connector 345 and the return hose 450.

Referring to FIG. 4, the return hose 450 can be connected to the pump outlet 316 by a hose clamp 420, or other suitable means, to ensure a watertight connection therebetween. The return hose 450 can extend a desired distance away from the housing 305 to allow adequate separation between return water and the water intake—through the skimmer assembly 325 and the connection assembly 340. In other words, the return and the intake should be sufficiently spaced apart to prevent the same water from recirculating through the cleaning system 200.

The return hose 450 can connect to the return line fitting 410 through a series of watertight connections. For example, as shown in an exemplary embodiment of the present invention in FIG. 4, the return hose 450 can connect to an elbow fitting 415 using an interposed O-ring or other washer or gasket and a hose clamp 420 or other connector to ensure a watertight connection therebetween. The elbow fitting 415 can connect the return line fitting 410 through an aperture in the sidewall 120 of the pool 100. A watertight connection between the elbow fitting 415 and the return line fitting 410 can be achieved, for example, using a pipe nut and a thrust washer on the outer sidewall 128 of the pool 100. Furthermore, a gasket can be used between the return line fitting 410 and the inner sidewall 126 of the pool 100. The return line fitting 410 can be fitted with a diverter fitting to divert return water flow away from the skimmer port 360.

Referring back to FIGS. 2*d* and 3*a*, the skimmer port 360 can be attached to the sidewall 120 of the pool 100 through an aperture 190. The attachment assembly 340 can include an outer gasket 375, that can be positioned between the outer sidewall 128 of the sidewall 120 of the pool 100, and an inner gasket 380 and skimmer faceplate 385 adjacent the inner sidewall 126 of the pool 100. The skimmer port 360 can be attached flush to the outer gasket 375. The skimmer faceplate 385 can also be flush to the inner gasket 380, with no need for a flange, lip, or other projection extending through the sidewall 120 of the pool 100. The skimmer port 360, outer gasket 375, inner gasket 380, and skimmer faceplate 385 can be attached through the sidewall 120 using a plurality of fasteners 390, such as screws or other fasteners, to achieve a watertight connection between the skimmer port 360 and the skimmer faceplate 385.

As illustrated in FIG. 4, the connection of the skimmer port 360 to the skimmer faceplate 385 through the sidewall 120 of an above-ground pool 100 can suffice as the only needed physical support to mount and maintain the entire cleaning system. In some embodiments, the housing 305 can further be provided with a stabilizing foot that can rest against, or be attached to, the outer sidewall 128 of the sidewall 120.

Figure 5:
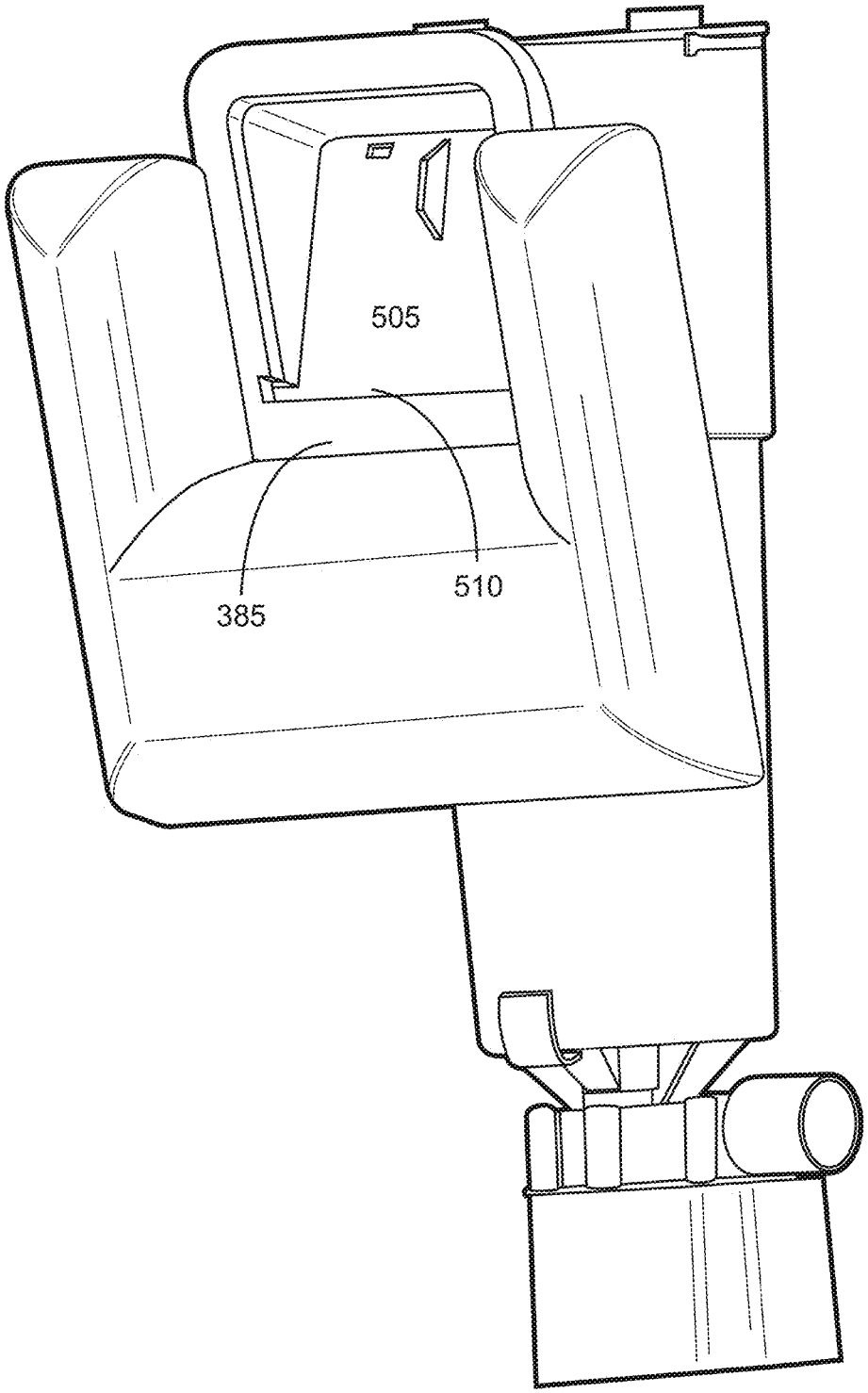
FIG. 5 is a perspective view of the cleaning system of FIGS. 3*a* and 3*b* with a weir installed, in accordance with an exemplary embodiment of the present invention.

The skimmer faceplate 385 as shown in FIG. 5 can be provided with a weir 505. The weir 505 can be pivotally attached to the skimmer faceplate 385 in a one-way manner to reduce or restrict movement of the weir 505, such that water flow can be admitted into the skimmer port 360, but the weir 505 can flap closed against the skimmer faceplate 385 and reduce or restrict water from leaving the skimmer port 360. The weir 505 can further be provided with one or more weir foam elements, seals, or gaskets disposed on the perimeter of the weir 505 to assist the sealing of the weir 505 against the skimmer faceplate 385 and further restrict the flow of water out of the skimmer port 360 when the pump assembly 310 is not operating.

In operation, the pump assembly 310 can draw water from the pool 100 via the weir 505 into the skimmer port 360. Large particulate matter suspended in the water can be collected by the skimmer assembly 325. Smaller particulate matter within the pool water not removed by the skimmer assembly 325 can be then removed by the filter cartridge 355. In some embodiments, the filter assembly 320 can be provided with a space to contain chlorine tablets or other chemical delivery devices to maintain a desired antimicrobial chemical level within the water. The water can then be drawn through the hollow cavity 315 of the housing 305 and into the pump inlet 314. Water flow can then exit the pump assembly 310 through the pump outlet 316, and can enter the return hose connector 345 to return to the pool 100 via the return hose 450 and the return line fitting 410.

Access for emptying the skimmer assembly 325 and replacement of the filter cartridge 355 can be achieved through removal of the top 350 by a user, whereupon the skimmer assembly 325 and the filter cartridge 355 can be readily removed from the housing 305 and replaced as desired or needed.

Figure 6:
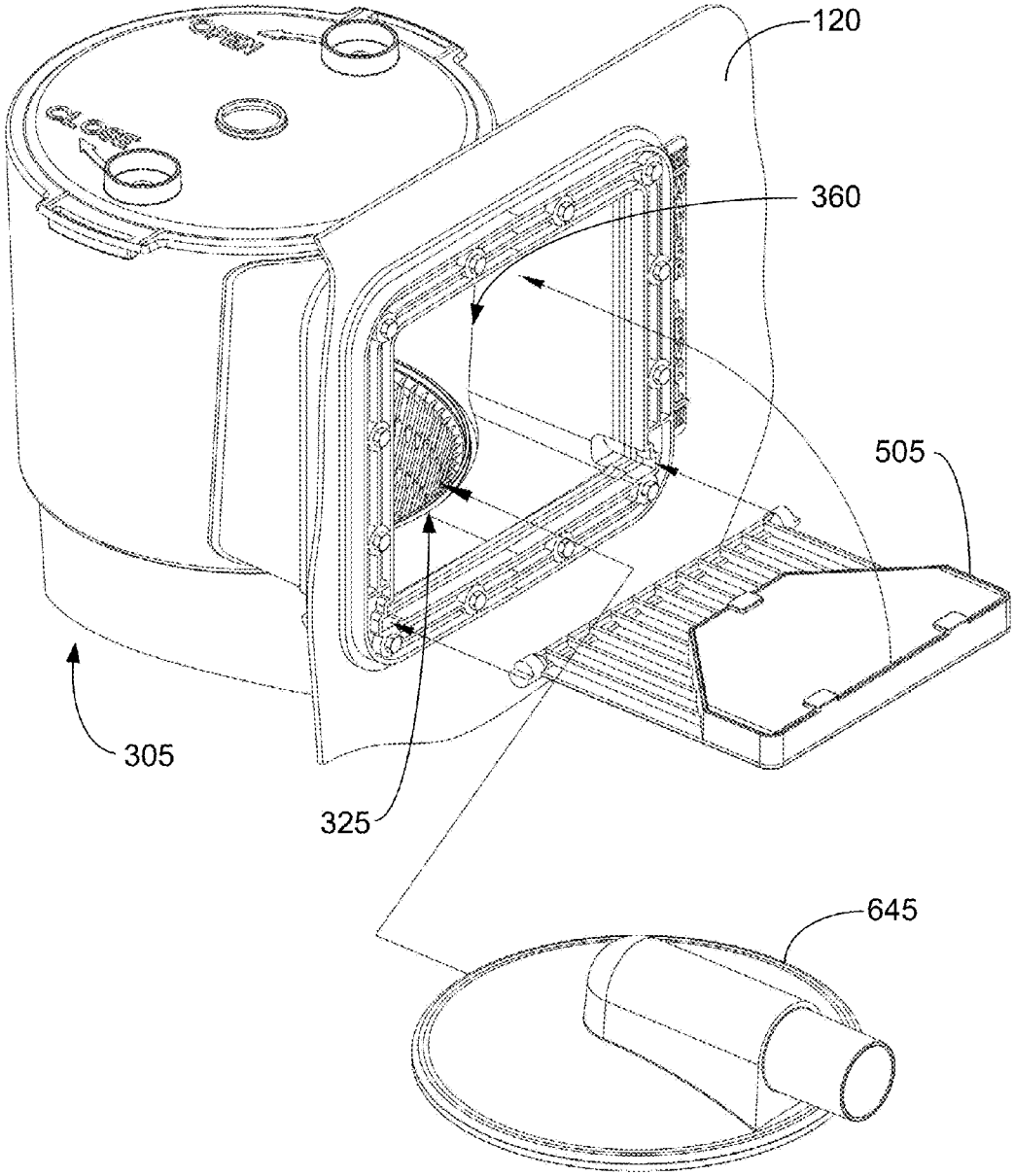
FIG. 6 is a perspective view of a pool vacuum connector for use with the cleaning system of FIGS. 3*a* and 3*b* and 5, in accordance with some embodiments of the present invention.

If desired, as shown in FIG. 6, a user can connect a pool vacuum connector 645 sized and shaped to fit through the weir 505 and skimmer port 360. The pool vacuum connector 645 can sealably fit atop the skimmer assembly 325 within housing 305. In some embodiments, the pool vacuum connector 645 can be provided with a connector to connect a vacuum hose a vacuum device (not shown). In such embodiments, when the pool vacuum connector 645 is attached, negative water pressure from the pump assembly 310 can be used to power a pool vacuum device to remove debris from the bottom of the pool and can be collected by the skimmer assembly 325 and removable filter cartridge 355.

In essence, the cleaning system 200 can be adapted to remove debris via the skimmer assembly 325 and the filter assembly 320, by pulling water into the housing 305 via the pump assembly 310. The cleaning system 200 can be lightweight enough to be fully supported by the sidewall 120 of the pool 100, such that a base or other support is not needed to properly position and support the cleaning system 200.

Pump Assembly

Figure 7:
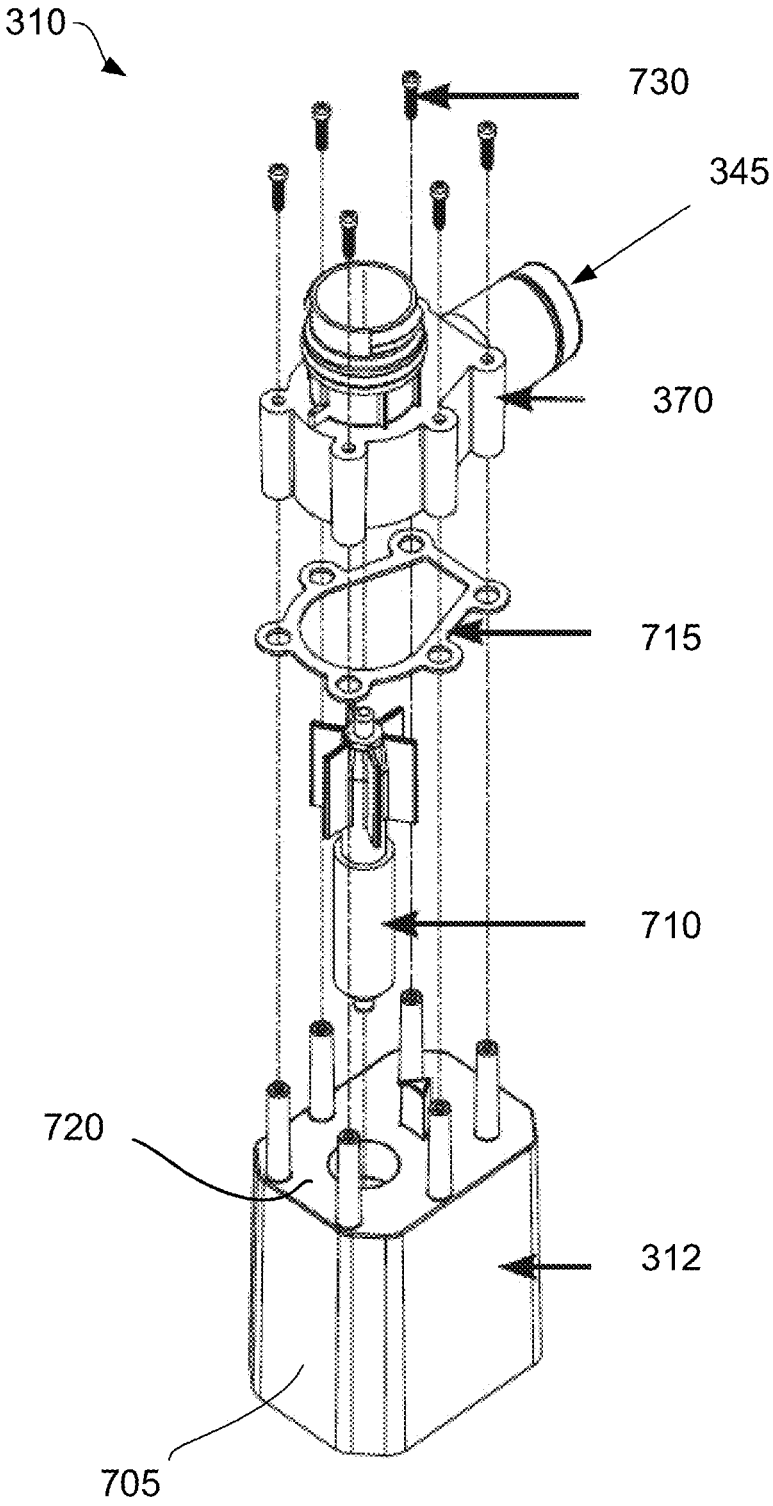
FIG. 7 is a perspective, exploded view of a pump for use with the cleaning system of FIGS. 3*a* and 3*b* and 5, in accordance with some embodiments of the present invention.

FIG. 7 illustrates an exploded view of the pump assembly 310. As noted, the pump assembly 310 can be adapted to control the operation of the cleaning system 200. The pump assembly 310 can pull fluid, typically water, from the above-ground container, e.g., the above-ground swimming pool, to be skimmed by the skimmer assembly 325, and then filtered by the filter assembly 320.

The pump assembly 310 includes the pump 312, which can be the device that pulls the fluid towards, and ultimately into, the housing 305. The pump assembly can include a pump body 705 to contain the pump 312. A rotor assembly 710 (shown in more detail in FIG. 8, and described more fully below) can be coupled to the pump body 705. A pump gasket 715 can be positioned atop the top portion 720 of the pump body. A manifold 370 can provide the pump inlet 314 and return hose connector 345 for fluid to enter/exit the pump assembly 310.

In some embodiments, the manifold 370, pump gasket 715 and rotor assembly 710 can be secured to the top portion 720 of the pump body 705 with fasteners 730, such as, for example and not limitation, screws or bolts. In some embodiments, the pump assembly 310 may be an integral, factory-sealed unit, such that no fasteners 730 are necessary.

Rotor Assembly

Figure 8:
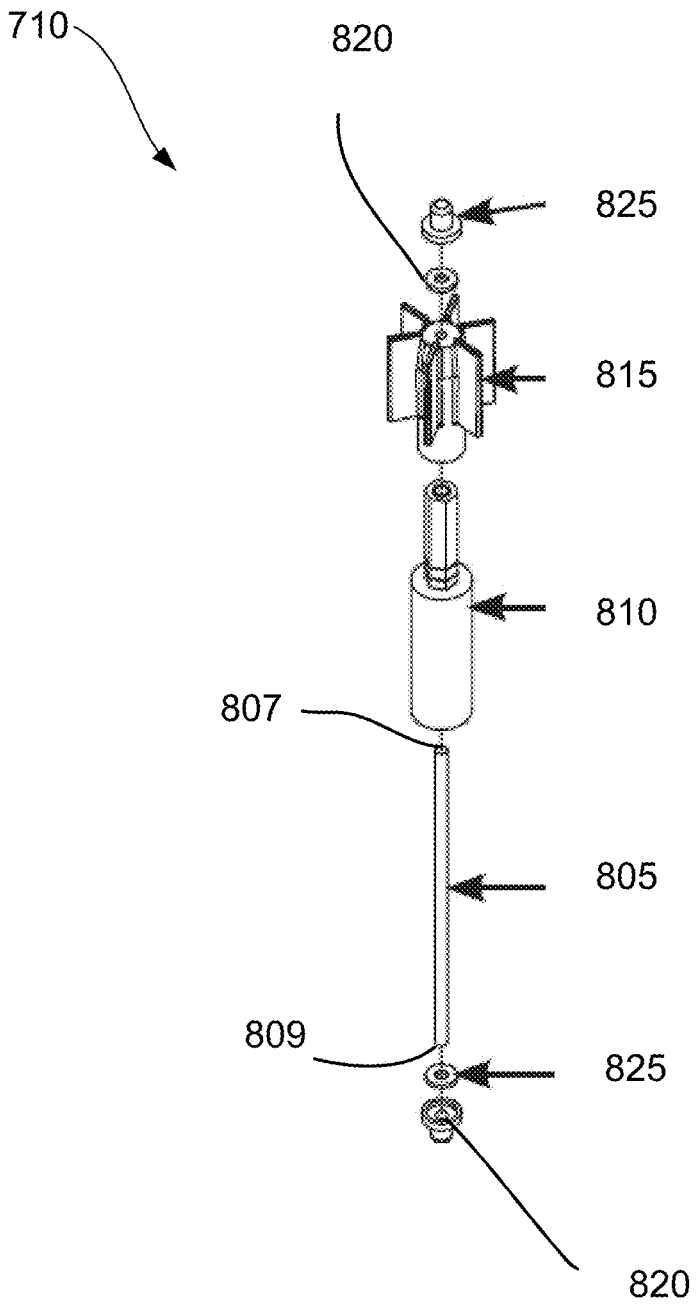
FIG. 8 is an exploded view of a rotor assembly of the pump assembly of FIG. 7, in accordance with an exemplary embodiment of the present invention.

Referring now to FIG. 8, the rotor assembly 710 of the pump assembly 310 is illustrated in a perspective view. The rotor assembly 710 can include an elongated shaft 805 having a first end 807 and a second end 809. The shaft 805 can be received by the axle 810, and can be connected to the impeller 815 via an end cap 820 and a washer 825 at the shaft's first end 807. In some embodiments, the axle 810 can be magnetic. In some embodiments, both ends 807, 809 of the shaft 805 can be positioned with an end cap 820 and a washer 825.

The pump assembly 310 can be adapted to rotate the rotor assembly 710. Specifically, the pump 312 can rotate the shaft 805, which can rotate the impeller 815. Together with the pump assembly 310, the rotor assembly 710 can enable water to be pulled into the housing 305 of the cleaning system 200.

Methods of Installation

Embodiments of the present invention can include a method of installing the cleaning system 200 on a pool 100. The cleaning system 200 can be secured to the pool 100, and does not need support from a separate base. Due to risk of electrical shock, it is preferred that the cleaning system 200 be connected to a grounding type receptacle protected by a ground fault circuit interrupter (GFCI). The receptacle is preferably at least ten feet away from the pool 100.

To install the cleaning system, the top 350, skimmer assembly 325, and filter cartridge 355 can be removed from the housing 305. The pump assembly 310 can be connected to the lower portion 330 of the housing 305. The pump assembly 310 can be inserted until it bottoms out in the manifold 370 and attached thereto. The manifold 370 can be inserted into the bottom of the housing 305 and affixed using a suitable method. In some embodiments, the pump assembly 310 can be connected such that the manifold 370 extends out to a side of the housing 305, as illustrated in FIG. 7.

Installation continues by determining a location on the sidewall 120 of the pool 100 for mounting the cleaning system 200. The inner gasket 380 and the skimmer faceplate 385 are installed on the inner sidewall 126 (inside the pool 100) by fasteners 390, such as screws or bolts, for example, as shown in FIG. 3*a*. The outer gasket 375 can be secured to the outer sidewall 128 (outside the pool 100), and secured also by fasteners 390. The housing 305 can be coupled to the outer gasket 375. In an alternative embodiment, the fasteners 390 can extend through the skimmer faceplate 385, inner gasket 380, and outer gasket 375 and into the housing 305. In still other embodiments, the fasteners 390 can extend through the skimmer faceplate 385, inner gasket 380, outer gasket 375, and the housing 305 and be secured with nuts and washers (i.e., through-bolted).

Figure 9:
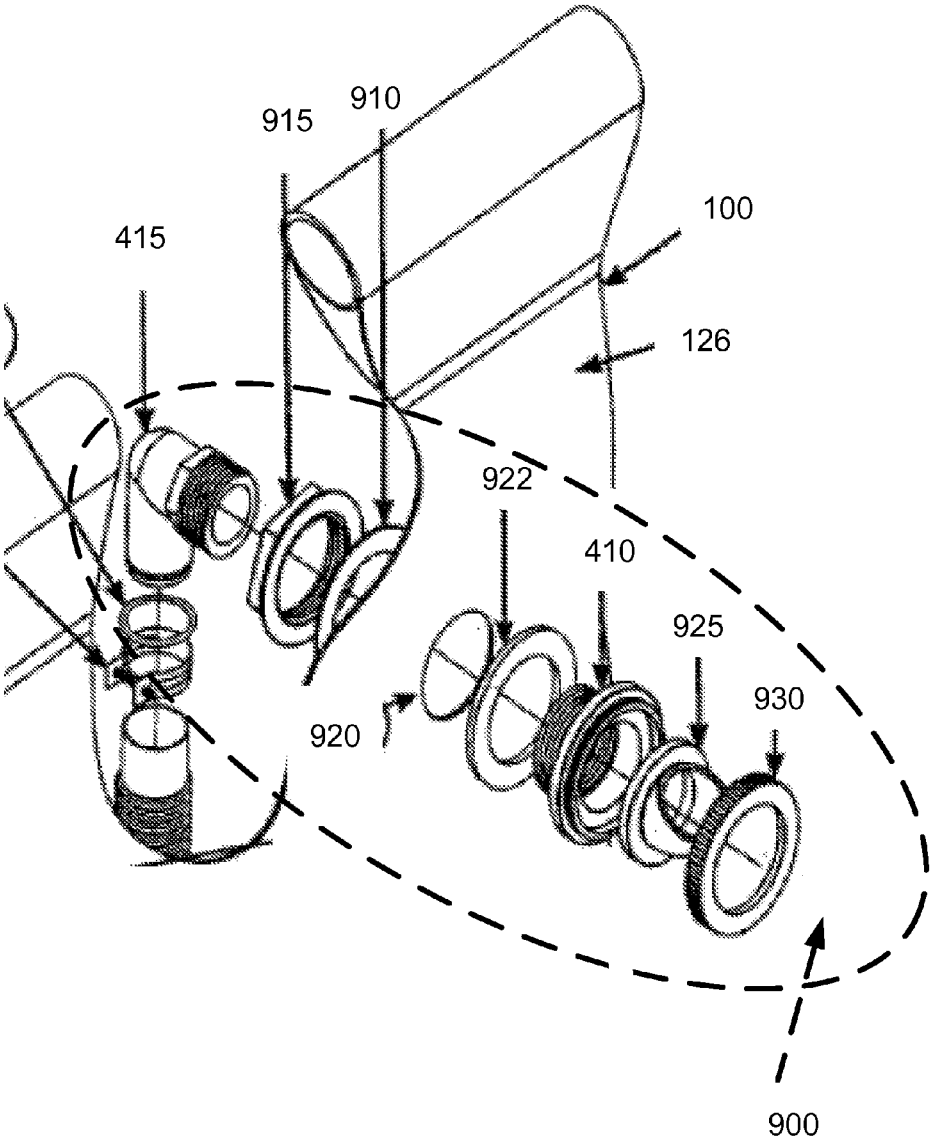
FIG. 9 is an exploded view of a return line pool connector assembly of FIG. 4, in accordance with an exemplary embodiment of the present invention.

The return connection assembly 900, shown in FIG. 9, for the return hose 450 can be installed. The gasket 922 can be lubricated, and then installed over the threads of the return line fitting 410. The return line fitting 410 can be inserted through an aperture 920 in the sidewall 120. A thrust washer 910 can be placed over the return line fitting 410, and then a pipe nut 915 can be threaded until the return line fitting 410 is hand tight. The return line fitting 410 not be over tightened because this can crack the return line fitting 410 and can cause wrinkles in the sidewall 120, which could ultimately compromise the integrity of the sidewall 120. In some embodiments, tape, such as Teflon® tape, can be applied to the thread of the elbow fitting 415 to prevent leaks, and it can be installed to the return line fitting 410.

Next, the return hose 450 can be secured to the pump assembly 310 and the return connection assembly 900. As shown in FIG. 4, the return hose 450 has a first end 452 connected to the pump assembly 310, and a second end 454 connected to the elbow fitting 415. The first end 452 of the return hose 450 can be connected to the pump assembly 310 by a hose clamp 420, or other suitable method. The hose clamp 420 can first be loosened before sliding it over the first end 452 of the return hose 450. Specifically, the first end 452 of the return hose 450 can be connected to the manifold 370 of the pump assembly 310. The second end 454 of the return hose 450 can be connected to the elbow fitting 415 of the return connection assembly 900. Both of the hose clamps 420 can then be tightened.

The filter assembly 320 and skimmer assembly 325, including the filter cartridge 355 and the skimmer assembly 325, can be re-inserted back into the housing 305. The filter cartridge 355 can slip over the aperture 365, and can seal at the bottom of the housing 305. Accordingly, the skimmer assembly 325 can sit in a groove in the hollow cavity 315 of the housing 305. The top 350 can then be twisted back into place until locked.

The weir 505 can be slid into grooves 510 inside the skimmer faceplate 385, and once inside can be flipped over and locked into place. The weir 505 can be pushed in the grooves 510, as shown in FIG. 5. After the pool 100 is filled with water, it is preferable that all hose connections and fittings are checked to ensure that there can be no leakage.

Method of Cleaning Filter Assembly

Embodiments of the present invention can also include a method of cleaning the filter assembly 320. Before cleaning the filter assembly 320, electrical power to the cleaning system 200 should be turned off. In addition, the skimmer assembly 325 and the filter cartridge 355 should be removed from the housing 305. The design of the cleaning system 200 enables the filter assembly to be removed and cleaned more easily than conventional designs.

The filter cartridge 355 can be cleaned of coarse debris by pressure washing, ensuring that each individual pleat of the cartridge is washed. It has been found that fine particles are more easily removed from the pleats when the filter cartridge 355 is dry. Therefore, it may be preferable, after pressure washing the filter cartridge 355, to allow it to dry and then carefully brush it. The pleats, however, should not be scrubbed. Cleaning or scrubbing the filter cartridge 355, specifically the pleats, too vigorously will create accelerated wear when compared to simply hosing it off.

Suntan oils, body oils, algae, and the like can form a coating or film on the pleats of the filter cartridge 355, which often cannot be completely removed by pressure washing. Such films can quickly clog the filter's pores, and thus greatly reduce filtration. Therefore, it is be preferable to remove such materials from the filter cartridge 355 as quickly as possible. To remove oils, the cartridge can be soaked in a solution of, for example and not limitation, about one pound of tri-sodium phosphate (or other strong detergent) in about five gallons of water for up to twelve hours. Tri-sodium phosphate is a commonly available detergent solution. After the oils have been removed, it is preferable to rinse the filter cartridge 355 to remove remaining dirt.

If, however, algae is a problem, it may be preferable to add, for example and not limitation, about half a pint of pool chlorine or one pint of liquid household bleach to the above cleaning solutions approximately one hour before removing the filter cartridge 355 from the solution. Thoroughly rinsing the filter cartridge 355 is recommended before replacing the filter cartridge 355 in the cleaning system 200.

Method of Diverter Fitting Use

Embodiments of the present invention can further provide a method for using a diverter fitting in the pool. Using a diverter fitting 925 can redirect the return water entering the pool 100. The diverter fitting 925 can be adjusted by loosening the locking ring 930. The diverter fitting 925 can be used to generate clockwise or counter-clockwise rotation of pool water, depending on its orientation. In some embodiments, the diverter fitting 925 can be used to direct water towards the skimmer assembly 325. In other embodiments, the diverter fitting 925 can be used to direct water away from the skimmer assembly 325 to prevent excessive water recirculation.

To change diverter fitting 925 orientation, the locking ring 930 can be slightly loosened and the diverter fitting 925 can be rotated. It may be preferable for the diverter fitting 925 not to be pointed directly toward the skimmer port 360 area, as this will decrease skimming and filtration, because water is not being forced around the pool 100. When the desired position for the diverter fitting 925 is obtained, the locking ring 930 can be tightened. In some embodiments, the diverter fitting 925 can be positioned downwardly—towards the base 110 of the pool 100—to assist in keeping settlement from building up along the bottom of the pool 100.

Method of Vacuum Adapter Use

Embodiments of the present invention can also provide a method of using a vacuum adapter with the cleaning system 200. The cleaning system 200 can be adapted to receive a vacuum adapter or pool vacuum connector 645, enabling vacuuming of the base 110 and/or sidewall 120 of the pool 100. The pool vacuum connector 645 can be adapted to couple to a pool vacuum (not shown), which can be in communication with a pool handle (not shown), as well as a vacuum hose (also not shown).

To install the pool vacuum connector 645, the pump assembly 310 should be initially turned off and the weir 505 lowered and/or removed. The pool vacuum can be connected to its handle, and the lowered into the pool 100. The vacuum hose, which may float, can be connected to the pool vacuum at a first end, and the second end, which can be loose, can be positioned near the diverter fitting 925. The pump assembly 310 can be turned on, and the second end of the vacuum hose placed in front of the diverter fitting 925 enabling water to fill the hose causing it to sink.

Once the vacuum hose is filled, the pump assembly 310 can again be turned off, the pool vacuum connector 645 can be slid into the skimmer port 360, and the vacuum hose can be connected to the pool vacuum connector 645. By restarting the pump assembly 310, the pool vacuum will begin to pull debris and other particulates through the vacuum and into the cleaning system 200. The user can now vacuum along the desired section of the pool 100.

The vacuum hose should not be used alone, i.e., without the pool vacuum, as liner damage to the bottom of the pool can occur. Additionally, one should not vacuum with the skimmer assembly 325 or with the filter cartridge 355 removed, as pump 312 blockage and/or damage can occur. Further, the vacuum hose should not be left hanging out of the pool, as a siphon can occur draining the pool 100.

When vacuuming is complete, the pump assembly 310 should be turned off. The pool vacuum connector 645 can then be removed from the housing 305 and the weir 505 can be reinstalled, if applicable. The vacuum hose and pool vacuum can then be drained, preferably back into the pool 100. Due to the amount of debris generally gathered during vacuuming, it is recommended that the skimmer assembly 325 and filter cartridge 355 be removed and cleaned after vacuuming.

Attachment Assembly

In some embodiments, it may be necessary or desirable for the attachment assembly 340 to be angled. Due to the typically bulging sidewalls of ring-type pools, angled mounting of the cleaning system 200 can be particularly desirable. See, e.g., FIG. 2*c*. In some embodiments, an angled attachment assembly 340 can minimize the material required to attach the cleaning system 200 to the sidewall 120 of the pool 100. Angling the attachment assembly 340 can reduce the amount of material, and the strength of material, required to manufacture the attachment assembly 340.

Mounting the cleaning system 200 at an angle $\alpha$ that matches, i.e., is substantially parallel to, the sidewall 120 of the pool also minimizes the distance the cleaning system 200 protrudes from the sidewall 120 of the pool 100. This can minimize the chances of injury to users and damage to the cleaning system 200 due to inadvertent contact with the cleaning system 200 while moving or playing around the pool 100. Mounting the cleaning system 200 at an angle $\alpha$ can also discourage users from attempting to use the cleaning system 200 for ingress and egress to the pool 100 as it does not present a level surface. This can further reduce the risk of injury to the users and damage to the cleaning system 200. See, FIG. 3*b*.

Mounting the cleaning system 200 at an angle $\alpha$ that matches the sidewall 120 of the pool 100, however, can require the cleaning system 200 to be designed to operate at the mounting angle $\alpha$. In some embodiments, the cleaning system 200 can further comprise a float system on the weir 505 to ensure the water in the cleaning system 200 is maintained at a consistent level. In some embodiments, the cleaning system 200 can be equipped with a float switch, or other safety device to prevent the pump assembly 310 from running when there is insufficient water in the housing 305. This can prevent pump 312 burnout due to insufficient lubrication. In some embodiments, the pump assembly 310 and/or rotor assembly 710 may be equipped with larger and/or additional bearings to accommodate operation at the mounting angle $\alpha$.

Beneficial Features of the Cleaning System of the Present Invention

There are many beneficial features of the present invention, including improved filter cleaning and/or replacement, chemical maintenance/chlorine dispensing, pool water surface debris cleaning, cleaning pool bottom and side walls, and general safety. Tables 1-6 identify some of the advantages of these beneficial features.

TABLE 1

| Filter Cleaning and/or Replacement | |
|---|---|
| Industry Standard Pump/Filter System | Skimmer Pump/Filter System |
| 1. Unplug unit's power cord.<br>2. Remove intake fitting strainer (located inside pool about half way down the wall). | 1. Unplug unit's power cord.<br>2. Remove top - turn approximately 25°.<br>3. Remove strainer basket. |

TABLE 1-continued

| Filter Cleaning and/or Replacement | |
|---|---|
| Industry Standard Pump/Filter System | Skimmer Pump/Filter System |
| 3. Locate and install plug into intake fitting.<br>4. Remove return fitting strainer (located inside pool about half way down the wall and at least approximately 3' from intake fitting).<br>5. Locate and install plug into return fitting.<br>6. Open vent screw - turn approximately 360°.<br>7. Remove top retainer ring - turn approximately 720°.<br>8. Remove top.<br>9. Remove filter cartridge - clean and/or replace.<br>10. Install filter cartridge.<br>11. Check to see if O-ring seal is in correct place and has not been damaged or lost - may need to lubricate o-ring.<br>12. Install top.<br>13. Install top retainer - tighten for a water tight seal.<br>14. Loosely tighten vent screw.<br>15. Remove return fitting plug.<br>16. Install return fitting strainer.<br>17. Remove intake fitting plug.<br>18. Install intake fitting strainer.<br>19. Store intake and return fitting plugs in a safe place.<br>20. Open vent screw to vent air from filter system.<br>21. Tighten vent screw and check to make sure filter system is not leaking.<br>22. Re-plug unit's power cord.<br>23. Check for proper flow - e.g., place hand in pool at return fitting and feel the water flow.<br>24. Recheck filter system for leaks - if leaks are found, go to the troubleshooting section of your pool manual for instructions.<br>Note:<br>These tasks are performed at ground level and inside the pool. May requires more movement to access all the service areas. | 4. Remove filter cartridge - clean and/or replace.<br>5. Install filter cartridge.<br>6. Install strainer basket.<br>7. Install top.<br>8. Re-plug unit's power cord.<br>9. Check for proper flow - look at surface of water at return fitting.<br>Note:<br>Most of these tasks may be performed in the standing position at one location. |

TABLE 2

| Chemical Maintenance and Chlorine Dispensing | |
|---|---|
| Industry Standard Pump/Filter System | Skimmer Pump/Filter System |
| 1. Unplug unit's power cord.<br>2. Remove intake fitting strainer (located inside pool about half way down the wall).<br>3. Locate and install plug into intake fitting.<br>4. Remove return fitting strainer (located inside pool about half way down the wall and at least approximately 3' from intake fitting).<br>5. Locate and install plug into return fitting.<br>6. Open vent screw - turn approximately 360°.<br>7. Remove top retainer ring - turn approximately 720°. | 1. Unplug unit's power cord.<br>2. Remove top - turn approximately 25°.<br>3. Remove strainer basket.<br>4. Add chlorine tablets.<br>5. Install strainer basket.<br>6. Install top.<br>7. Plug unit's power cord in.<br>8. Check for proper flow - look at surface of water at return fitting.<br>Note:<br>Most of these tasks may be performed in the standing position at one location. |

TABLE 2-continued

| Chemical Maintenance and Chlorine Dispensing | |
|---|---|
| Industry Standard Pump/Filter System | Skimmer Pump/Filter System |
| 8. Remove top.<br>9. Add chlorine tablets. Please note this is not an option unless you are using GFP's patented filter cartridge.<br>10. Check to see if O-ring seal is in correct place and has not been damaged or lost - may need to lubricate o-ring.<br>11. Install top.<br>12. Install top retainer - tighten for a water tight seal.<br>13. Loosely tighten vent screw.<br>14. Remove return fitting plug.<br>15. Install return fitting strainer.<br>16. Remove intake fitting plug.<br>17. Install intake fitting strainer.<br>18. Store intake and return fitting plugs in a safe place.<br>19. Open vent screw to vent air from filter system.<br>20. Tighten vent screw and check to make sure filter system is not leaking.<br>21. Re-plug unit's power cord.<br>22. Check for proper flow - e.g., place hand in pool at return fitting and feel the water flow.<br>23. Recheck filter system for leaks - if leaks are found, go to the troubleshooting section of pool manual for instructions.<br>Note:<br>These tasks are performed at ground level and inside the pool. May Require more movement to access all the service areas. | |

TABLE 3

| Pool water surface and debris cleaning | |
|---|---|
| Industry Standard Pump/Filter System | Skimmer Pump/Filter System |
| Equipment Required:<br>Skimmer net with extension pole - walk around the pool with the skimmer net and manually remove all the surface debris. | Equipment Required:<br>Nothing - the system performs the task as the pump is running. |

TABLE 4

| Cleaning Pool Bottom Sidewalls | |
|---|---|
| Industry Standard Pump/Filter System | Skimmer Pump/Filter System |
| Equipment Required:<br>Vacuum head<br>Extension pole<br>Garden hose - preferably long enough to get from faucet to far side of pool.<br>Note:<br>This system uses water pressure from your garden hose and will add additional water to the pool. It may overfill the pool and/or require drainage of some water. | Equipment Required:<br>Vacuum head<br>Extension pole<br>Approximately 1¼" Flex hose 1¼ times the pool diameter in length.<br>Note:<br>This system uses the pool pump for power and the existing water in the pool. |

TABLE 5

| Safety Considerations (ANSI/NSPI-4 STD) | |
|---|---|
| Industry Standard Pump/Filter System | Skimmer Pump/Filter System |
| 1. Pump located on ground - tripping hazard.<br>2. Intake and return hoses going to pool - tripping hazard.<br>3. Filter system being used as a step for small children to access pool.<br>4. Pool wall fitting being used as a step for small children to access the pool.<br>5. Filter pump system is very light - children could pick this up and put it in the pool.<br>6. Suction fitting in pool - below water level - entrapment hazard. | 1. N/A<br>2. N/A<br>3. N/A<br>4. N/A<br>5. N/A<br>6. N/A |

TABLE 6

| Possible seal failure/water leak sources | |
|---|---|
| Industry Standard Pump/Filter System | Skimmer Pump/Filter System |
| 1. Intake fitting gasket on pool wall.<br>2. Intake hose connection on pool wall fitting.<br>3. Intake hose connection on filter case.<br>4. Vent screw o-ring seal.<br>5. Seal top o-ring seal. | 1. Skimmer face plate gasket.<br>2. Pump to filter connection seal.<br>3. Return hose connection at pump.<br>4. Return hose connection at pool wall fitting.<br>5. Return fitting gasket on pool wall. |

TABLE 6-continued

| Possible seal failure/water leak sources | |
|---|---|
| Industry Standard Pump/Filter System | Skimmer Pump/Filter System |
| 6. Pump to filter connection seal. Note: some pumps use a hose to connect the filter to the pump and this would add two more seals at the hose connections. | |
| 7. Return hose connection at pump. | |
| 8. Return hose connection at pool wall fitting. | |
| 9. Return fitting gasket on pool wall. | |

From the foregoing, it can be seen that the invention provides a number of different cleaning systems, which can be used to clean a swimming pool. The cleaning system of the present invention is lightweight enough that it can preferably be solely supported by the side wall of the pool in a non-vertical orientation. The various embodiments of the invention described above provide methods of installing the cleaning system when compared with prior approaches.

It will be appreciated by those skilled in the art, however, that the invention can be embodied in other specific forms without departing from the spirit or essential characteristics thereof. For example, while the invention has been described in the context of a cleaning system, the concepts described herein need not be limited to these illustrative embodiments.

Additionally, the specific configurations, choice of materials, and the size and shape of various elements could be varied according to particular design specifications or constraints requiring a container constructed according to the principles of the invention. Such changes are intended to be embraced within the scope of the invention.

The presently disclosed embodiments, therefore, are considered in all respects to be illustrative and not restrictive. The scope of the invention is indicated by the appended claims, rather than the foregoing description, and all changes that come within the meaning and range of equivalents thereof are intended to be embraced therein.

What is claimed is:

1. A lightweight cleaning system for cleaning and filtering liquids in an above-ground container, comprising a sidewall, including an inner sidewall, an outer sidewall, a base, and a first aperture, the system comprising:

a housing defining a cavity and comprising:

a skimmer assembly disposed in an upper portion of the cavity;

a filter assembly disposed below the skimmer in the cavity; and a pump assembly in fluid communication with a lower portion of the housing;

a faceplate disposed on the inner sidewall proximate the first aperture;

a bracket disposed on the outer sidewall proximate the first aperture and detachably coupled to the housing, the bracket angled such that the housing is non-vertical and substantially parallel to the sidewall; and a plurality of fasteners for detachably coupling the faceplate to the bracket and the bracket to the housing;

wherein the first aperture is covered in a water-tight manner by the faceplate and the bracket;

wherein the sidewall is non-vertical; and wherein the cleaning system is supported only by the sidewall of the container.

2. The cleaning system of claim 1, wherein the faceplate further comprises a weir to reduce the flow of water out of the housing and into the pool.

3. The cleaning system of claim 1, further comprising: an inner gasket, disposed between the faceplate and the inner sidewall to create a watertight seal therebetween.

4. The cleaning system of claim 1, further comprising: an outer gasket, disposed between the bracket and the outer sidewall to create a watertight seal therebetween.

5. The cleaning system of claim 1, wherein the above-ground container is a ring pool.

6. The cleaning system of claim 1, further comprising:

a return hose connection in fluid communication with the pump assembly;

a return connection assembly disposed proximate a second aperture in the sidewall and in fluid communication with the above-ground container; and a return hose, in fluid communication with the return hose connection and the return hose assembly for returning fluid from the cleaning system to the above-ground container.

7. The cleaning system of claim 1, wherein the bracket and the housing are integrally formed.

8. A method for installing a system for cleaning and filtering liquids in an above-ground container, comprising a sidewall, including an inner sidewall, an outer sidewall, a base, and a first aperture, the method comprising:

placing a faceplate over the first aperture proximate the inner sidewall;

placing a bracket over the first aperture proximate the outer sidewall; and affixing the faceplate to the bracket using a plurality of fasteners such that the first aperture is covered in a watertight manner by the faceplate on the inside and the bracket on the outside;

wherein the bracket further comprises a housing comprising:

a skimmer assembly disposed in an upper portion of the housing;

a filter assembly disposed below the skimmer; and a pump assembly disposed in a lower portion of the housing;

wherein the faceplate, bracket, and housing are supported solely by the sidewall of the above-ground container;

wherein the sidewall of the above-ground container is non-vertical; and wherein the bracket is angled such that the housing is non-vertical and substantially parallel to the non-vertical sidewall of the above-ground container.

9. The method of claim 8, further comprising: affixing the bracket to the housing a plurality of fasteners; wherein the bracket and the housing are separate components.

10. The method of claim 8, further comprising: affixing the pump assembly to the lower portion of the housing a plurality of fasteners; wherein the pump assembly and the housing are separate components.

11. The method of claim 8, further comprising: placing an inner gasket between the faceplate and the inner sidewall to create a watertight connection therebetween.

12. The method of claim 8, further comprising: placing an outer gasket between the bracket and the outer sidewall to create a watertight connection therebetween.

13. The method of claim 8, further comprising:

connecting a return hose to a return hose connection on the housing;

connecting the return hose to a return connection assembly disposed proximate a second aperture in the sidewall and in fluid communication with the above-ground container; and such that the return hose is in fluid communication with the return hose connection and the return hose assembly for returning fluid from the cleaning system to the above-ground container.

14. A cleaning system for cleaning and filtering liquids in an above-ground container, comprising a sidewall, including an inner sidewall, an outer sidewall, a base, and a first aperture, the system comprising:

a housing defining a cavity and comprising:

a skimmer assembly disposed in an upper portion of the cavity;

a filter assembly disposed below the skimmer in the cavity; and a pump assembly in fluid communication with a portion of the housing; and a bracket disposed on the outer sidewall proximate the first aperture and attached to the housing, the bracket configured to support the housing such that the housing is non-vertical and substantially parallel to the sidewall;

wherein the sidewall is non-vertical; and wherein the cleaning system is supported only by the sidewall of the container.

15. The cleaning system of claim 14, further comprising a faceplate with a weir to reduce the flow of water out of the housing and into the pool.

16. The cleaning system of claim 15, further comprising a plurality of fasteners for detachably coupling the faceplate to the bracket and the bracket to the housing.

17. The cleaning system of claim 14, wherein the above-ground container is an above-ground pool.

* * * * *